United States Patent [19]

Cantrell

[11] 4,376,425

[45] Mar. 15, 1983

[54] LUBRICATING APPARATUS FOR PUMPING UNIT ENGINES

[75] Inventor: Steven M. Cantrell, Ada, Okla.

[73] Assignee: Oklahoma Basic Economy Corporation, Ada, Okla.

[21] Appl. No.: 264,292

[22] Filed: May 18, 1981

[51] Int. Cl.[3] ..... F01M 9/10; F01M 1/00

[52] U.S. Cl. ..... 123/90.38; 123/196 R

[58] Field of Search ..... 123/90.38, 90.33, 196 R, 123/195 C, 198 E

[56] References Cited

U.S. PATENT DOCUMENTS

| | | | |
|---|---|---|---|
| 1,188,405 | 6/1916 | Brush | 123/90.38 |
| 1,356,914 | 10/1920 | Fekete | 123/90.38 |
| 1,403,540 | 1/1922 | Church | 123/90.38 |
| 1,438,163 | 12/1922 | Montgomery | 123/90.33 |
| 1,543,548 | 6/1925 | Cloyd | 123/90.38 |
| 2,902,022 | 9/1959 | Bakke et al. | 123/90.38 |

*Primary Examiner*—Charles J. Myhre
*Assistant Examiner*—E. Rollins Cross
*Attorney, Agent, or Firm*—Laney, Dougherty, Hessin & Beavers

[57] ABSTRACT

Apparatus for continuously lubricating a pumping unit engine having exposed valve and rocker arm means positioned at one end thereof comprising a housing adapted to be attached to the engine over the valve and rocker arm means for preventing dust and other foreign matter from depositing thereon, the housing including at least one lubricant flow passageway disposed in the top thereof positioned over the valve and rocker arm means when the housing is attached to the engine and a lubricant reservoir sealingly connected to the lubricant flow passageway in said housing whereby lubricant contained in the reservoir flows by gravity through the lubricant flow passageway in the housing and onto the valve and rocker arm means of the engine.

3 Claims, 5 Drawing Figures

LUBRICATING APPARATUS FOR PUMPING UNIT ENGINES

BACKGROUND OF THE INVENTION

1. Field of the Invention

The present invention relates to lubricating apparatus for pumping unit engines, and more particularly, but not by way of limitation, to apparatus for continuously lubricating pumping unit engines having exposed intake and exhaust valve means and rocker arm means positioned at one end thereof.

2. Description of the Prior Art

Pumping units are commonly used in the oil field for reciprocating strings of sucker rod disposed in oil wells. The sucker rod strings are connected to downhole pumps whereby oil is caused to flow from one or more oil producing subterranean formations to the surface.

In many oil fields, particularly where electric power is unavailable, such pumping units are powered by internal combustion unit engines. The most commonly used types of such pumping unit engines are single cylinder engines which rotate one or more flywheels and have the intake and exhaust valve means and rocker arm means positioned at one end thereof. While such one cylinder pumping unit engines can include a dust cover attached thereto for preventing dust and other foreign matter from depositing on the valve and rocker arm means of the engine, no provision is made on the engine for continuously lubricating the valve and rocker arm means and such lubrication must be accomplished manually on a frequent basis. Because the dust covers supplied with such engines inhibit the manual lubrication of the valve and rocker arm means thereof, most operators simply remove the dust covers or order engines without dust covers whereby the valve and rocker arm means are readily accessible for manual lubrication using conventional hand-held oil can apparatus. As will be readily understood by those skilled in the art, the absence of dust covers on such engines brings about the accumulation of dirt and grime on the valve and rocker arm means thereof causing rapid wear and increased maintenance, and the requirement that such engines be manually lubricated on a frequent basis increases the cost of operating pumping units equipped with such engines as well as making the engines subject to failure due to lack of lubrication. An example of such a one cylinder pumping unit engine requiring frequent manual lubrication is the engine manufactured by the Fairbanks-Morse Company.

By the present invention apparatus for continuously and automatically lubricating valve means, rocker arm means and other engine means requiring manual lubrication is provided which can be simply and easily attached to an engine of the type described above and which requires only the refilling of a lubricant reservoir with lubricant on an infrequent basis.

SUMMARY OF THE INVENTION

Apparatus for continuously lubricating a pumping unit engine having exposed intake and exhaust valve means and rocker arm means positioned at one end thereof comprising a housing including a top and a bottom adapted to be attached to the engine over the intake and exhaust valve means and over the rocker arm means for preventing dust and other foreign matter from depositing thereon, the housing including at least one lubricant flow passageway disposed in the top thereof positioned over the valve and rocker arm means when the housing is attached to the engine whereby lubricant flowing through the lubricant flow passageway flows by gravity onto the valve and rocker arm means thereby lubricating such means and a lubricant reservoir having a lubricant flow passageway disposed therein sealingly connected to the lubricant flow passageway in the housing whereby lubricant contained in the reservoir flows by gravity through the lubricant flow passageway in the housing and onto the valve and rocker arm means.

It is, therefore, a general object of the present invention to provide lubricating apparatus for pumping unit engines.

A further object of the present invention is the provision of apparatus for continuously lubricating a pumping unit engine having exposed intake and exhaust valve means and rocker arm means positioned at one end thereof which requires only the refilling of a lubricant reservoir on an infrequent basis.

Yet a further object of the present invention is the provision of apparatus for continuously lubricating the valve and rocker arm means of a pumping unit engine which is simple and easily attached to such engine.

Still a further object of the present invention is the provision of apparatus for continuously lubricating a pumping unit engine having exposed valve and rocker arm means wherein the apparatus prevents dust and other foreign matter from depositing on such means.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

Figure 1:
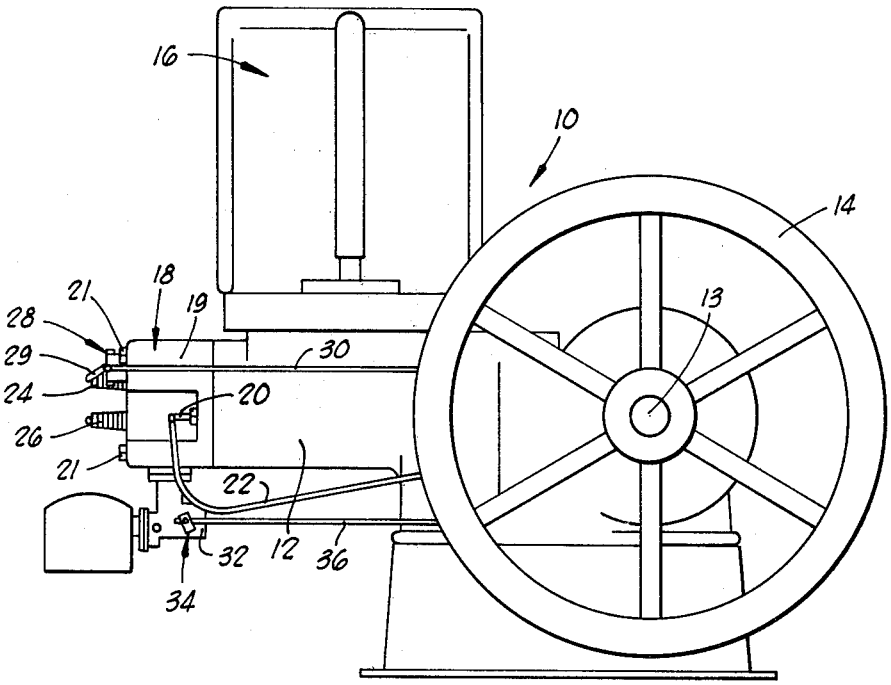
FIG. 1 (PRIOR ART)
FIG. 1 is a side elevational view of a typical one cylinder internal combustion pumping unit engine of the type described herein.

Referring now to FIG. 1, a typical one cylinder internal combustion pumping unit engine is illustrated and generally designated by the numeral 10. The engine 10 generally includes a block 12 containing a single cylinder and piston. The piston is operably connected by the usual piston rod and crank shaft 13 to one or more flywheels 14. The crank shaft 13 is also connected by belts or other drive means (not shown) to the pumping unit (also not shown) upon which the engine 10 is mounted. A cooling system, generally designated by the numeral 16 is mounted on and operably connected to the engine 10 and the engine block 12 includes an oil reservoir which is utilized to lubricate the internal parts of the engine 10 by the usual splash lubrication apparatus.

An engine block head assembly 18 is attached to the engine block 12 at the end thereof opposite the crank shaft 13 by four head bolts 21. The head assembly 18 includes a head 19 bolted to the block 12 which includes a sparkplug 20 threadedly connected into the usual ignition passageway in the head 19. The sparkplug 20 is connected to a conventional magneto (not shown) by a sparkplug wire 22. The head assembly 18 also includes an exhaust valve assembly 24 attached thereto with the push rod, spring and other mechanism associated therewith disposed externally to the head 19. An intake valve assembly 26 is attached to the head 19 and positioned below the exhaust valve assembly 24, also with the spring and other associated mechanism being disposed outside or external to the head 19. An external rocker arm assembly 28 is attached to the head 19 which includes a rocker arm 29 in operable contact with the exhaust valve mechanism 24. The end of the rocker arm 29 opposite the end in contact with exhaust valve assembly 24 is connected to an arm 30 which is in turn connected to the usual mechanism of the engine 10 for reciprocating the arm 30 and rocker arm 29. A carburetor 32 is attached to the head 19 which includes the usual rotatable throttle mechanism 34. The throttle mechanism 34 is connected to a throttle arm 36 which is in turn connected to a governor mechanism operably connected to the engine 10.

As will be understood by those skilled in the art, because the engine 10 utilizes means for splash lubricating the internal parts thereof and does not include a lubricant pump, the valve mechanisms 24 and 26, the rocker arm mechanism 28 and the throttle mechanism 34 must be lubricated manually on a frequent basis in order to insure the proper operation of the engine 10. Further, as mentioned above, because a dust cover for protecting the valve assemblies 24 and 26 and the rocker arm assembly 28 from deposits of dust and other foreign matter interferes with the manual lubrication of the valve and rocker arm assemblies, dust covers are usually left off or omitted from the engine 10. Thus, the valve and rocker arm assemblies accumulate dust and other foreign material which subject them to accelerated wear and increased maintenance.

Figure 5:
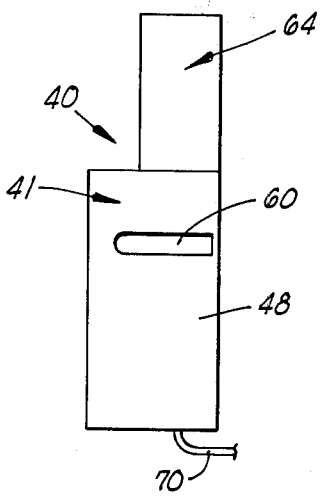
FIG. 5 is a side elevational view of the apparatus of the present invention.

Referring now to FIGS. 2–5, the apparatus of the present invention, generally designated by the numeral 40 is illustrated attached to the head 19 of the engine 10. The apparatus 40 is comprised of a housing 41 which is bolted to the head 19 of the engine 10 by means of the head bolts 21 thereof. While the housing 41 can take a variety of shapes, it is preferably formed of rectangular shaped front and back walls 42 and 44, respectively, rectangular side walls 46 and 48, and rectangular top and bottom walls 50 and 52, respectively. As shown best in FIGS. 3 and 4, a portion of the back wall 44 extends outwardly beyond the side wall 46 and includes a pair of bolt holes 54 disposed therein for receiving the head bolts 21 of the engine 10. The back wall 44 also includes a pair of bolt holes 56 on the opposite side thereof from the bolt holes 54 for receiving additional head bolts 21. In addition to the holes 54 and 56, the back wall 44 includes an opening 58 through which the valve assemblies 24 and 26 and rocker arm assembly 28 extend when the housing 41 is attached to the block 19 of the engine 10. In addition, as best shown in FIG. 5, the side 48 of the housing 41 includes a slot 60 disposed therein through which the rocker arm 29 of the rocker arm assembly 28 extends when the housing 41 is attached to the engine 10. In a preferred embodiment of the apparatus 40, the side 48 of the housing 41 is made readily removable such as by the use of bolts and wing nuts (not shown) whereby access to the interior of the housing 41 can be easily obtained.

Figure 2:
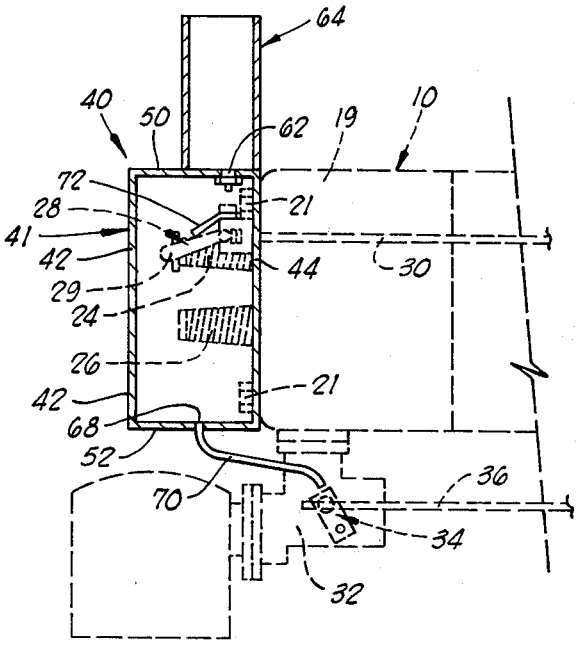
FIG. 2 is a side elevational view of the apparatus of the present invention taken in cross section and shown attached to an engine of the type illustrated in FIG. 1.
Figure 3:
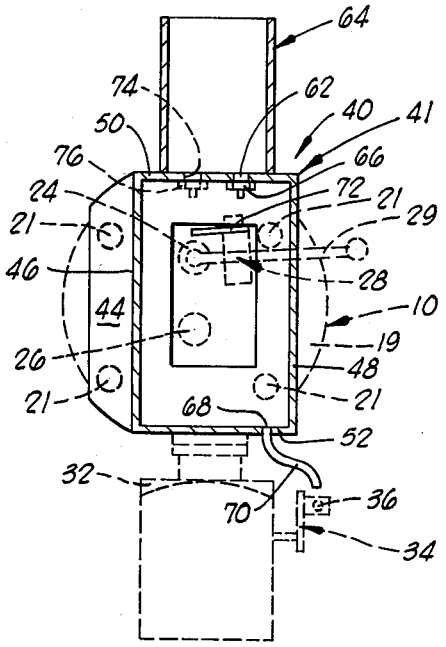
FIG. 3 is a front elevational view of the apparatus of the present invention taken in cross section and shown attached to an engine of the type illustrated in FIG. 1.
Figure 4:
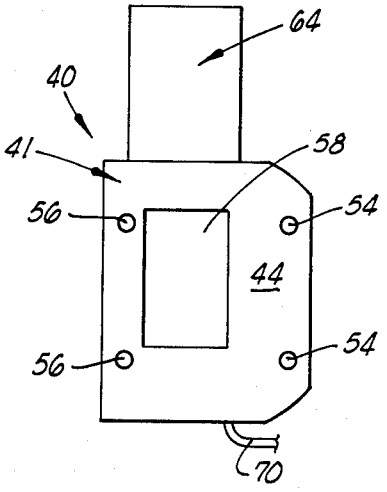
FIG. 4 is a back elevational view of the apparatus of the present invention.

As shown in FIGS. 2 and 3, the top 50 of the housing 41 includes at least one lubricant flow passageway 62 disposed therein. Positioned above the housing 41, and preferably attached thereto, is a lubricant reservoir 64. The reservoir 64 can take a variety of shapes and forms, but in whatever shape and form, it includes a lubricant flow passageway disposed therein for withdrawing lubricant from the reservoir 64 by gravity. Further, the lubricant flow passageway of the reservoir 64 is sealingly communicated with the lubricant flow passageway 62 disposed in the housing 41 whereby lubricant flows by gravity from the reservoir 64 through the passageway 62 to within the housing 41. In the form shown in the drawings, the reservoir 64 is an enclosure having an open top, four rectangular sides and an open bottom. The bottom of the reservoir 64 is sealingly connected to the top 50 of the housing 41 whereby lubricant contained within the reservoir 64 is communicated with the passageway 62 in the housing 41. In a preferred form of the present invention, an orifice 66 is attached within the housing 41 to and over the passageway 62 therein. The orifice 66 restricts the flow of lubricant flowing by gravity from the reservoir 64 through the passageway 62 and into the housing 41. Most preferably, the orifice 66 is threadedly connected into the passageway 62 in the top 50 of the housing 41 whereby it can be removed and orifices of various sizes substituted therefor.

A lubricant flow passageway 68 is disposed in the bottom 52 of the housing 41 for withdrawing excess lubricant from the housing 41. Attached to the bottom 52 of the housing 41 and sealingly connected to the passageway 68 therein is a conduit 70, such as a length of copper tubing, for conducting lubricant withdrawn from the housing 41 by gravity to another point requiring lubrication on the engine 10 such as the throttle mechanism 34 thereof.

In the embodiment shown in the drawings, the lubricant flow passageway 62 in the housing 41 and the orifice 66 attached thereto are positioned directly above the rocker arm assembly 28 of the engine 10. Attached to the rocker arm assembly 28 is a trough 72 for conducting lubricant from the rocker arm assembly 28 to the exhaust valve assembly 24. In this embodiment, lubricant flows by gravity from the reservoir 64 through the passageway 62 in the housing 41, through orifice 66 attached thereto and drips onto the rocker arm assembly 28. Excess lubricant flows over the trough 72 and drips onto the exhaust valve assembly 24. Excess lubricant from the valve assembly 24 drips onto the valve assembly 26 and from the valve assembly 26, excess lubricant drips onto the bottom 52 of the housing 41. From the housing 41 the lubricant accumulating therein flows by gravity through the flow passageway 68 and through the conduit 70 onto the throttle mechanism 34. Thus, by selecting an orifice 66 which regulates the flow of lubricant from the reservoir 64 to a proper rate, the rocker arm assembly 28, valve assemblies 24 and 26 and the throttle mechanism 34 of the engine 10 are continuously lubricated. As will be understood, the reservoir 64 can be of a relatively large size where it is only necessary to refill the reservoir with lubricant on an infrequent periodic basis.

In an alternate embodiment of the apparatus of the present invention, and referring specifically to FIG. 3, instead of the trough 72 attached to the rocker arm assembly 28, a second lubricant flow passageway 74 can be disposed in the top 50 of the housing 41 positioned over the valve assemblies 24 and 26 of the engine 10. A second orifice 76 can be connected to the housing 41 over the passageway 74 to restrict the flow of lubricant therethrough. In this embodiment, the trough 72 is eliminated and lubricant flows by gravity from the reservoir 64 through both of the passageways 62 and 74 in the housing 41, and the orifices 66 and 76 connected thereto whereby lubricant simultaneously drips onto the rocker arm assembly 28 and onto the valve assemblies 24 and 26.

The lubricating apparatus of the present invention can be adapted for attachment to various types and designs of engines, and the lubricant flow passageway or passageways in the housing of the apparatus can be positioned as required to lubricate one or more parts or mechanisms of the engine. As mentioned above, the lubricant reservoir can be separate from the housing of the apparatus and connected thereto by a conduit, or the reservoir can be directly attached to the housing as shown in the drawings. In addition, more than one lubricant flow passageway can be disposed in the bottom of the housing of the apparatus and more than one conduit can be connected to the flow passageways to conduct lubricant to more than one other point of lubrication on the engine to which the apparatus is attached. While numerous other changes can be made to the apparatus of this invention which will suggest themselves to those skilled in the art, such changes are encompassed within the spirit of this invention as defined by the appended claims.

What is claimed is:

1. Apparatus for continuously lubricating a pumping unit engine having exposed intake and exhaust valve means, rocker arm means and carburetor throttle mechanism positioned at one end thereof comprising:

a housing including a top and bottom adapted to be attached to said engine over said intake and exhaust valve means and over said rocker arm means for preventing dust and other foreign matter from depositing thereon, said housing including at least one lubricant flow passageway disposed in the top thereof positioned over said intake and exhaust valve means and said rocker arm means of said engine when said housing is attached to said engine whereby lubricant flowing through said lubricant flow passageway flows by gravity onto said valve and rocker arm means thereby lubricating such means;

an orifice for restricting the flow of lubricant flowing through said lubricant flow passageway attached to said housing over said passageway;

a lubricant reservoir having a lubricant flow passageway disposed therein sealingly connected to said lubricant flow passageway in said housing whereby lubricant contained in said reservoir flows by gravity through said lubricant flow passageways in said reservoir and in said housing, through said orifice and onto said valve and rocker arms means of said engine;

a second lubricant flow passageway disposed in the bottom of said housing for withdrawing excess lubricant therefrom by gravity; and a conduit sealingly attached to said second lubricant flow passageway for conducting lubricant withdrawn from said housing by gravity to said carburetor throttle mechanism whereby said mechanism is also lubricated.

2. The apparatus of claim 1 wherein said housing includes a pair of lubricant flow passageways disposed in the top thereof, each positioned over engine means to be lubricated when said housing is attached to an engine with said reservoir flow passageway being sealingly connected to said flow passageways in said housing.

3. The apparatus of claim 1 wherein said housing includes a single lubricant flow passageway disposed in the top thereof and said apparatus is further characterized to include a lubricant flow distribution means for attachment to said engine within said housing.

* * * * *